United States Patent [19]

Needs

[11] Patent Number: 4,644,663

[45] Date of Patent: Feb. 24, 1987

[54] MEASURING DEVICE

[76] Inventor: Steve Needs, 19351 NE. 1st Pl., Miami, Fla. 33179

[21] Appl. No.: 764,083

[22] Filed: Aug. 9, 1985

[51] Int. Cl.[4] ..... B43L 7/00

[52] U.S. Cl. ..... 33/486; 33/42; 33/476

[58] Field of Search ..... 33/173, 474, 479, 480, 33/486, 468, 476, 32 R, 32 B, 32 C, 1 G, 44, 42

[56] References Cited

U.S. PATENT DOCUMENTS

| | | | |
|---|---|---|---|
| 1,044,461 | 11/1912 | Linnemann | 33/437 |
| 1,160,051 | 11/1915 | Deitz | 33/486 X |
| 3,824,696 | 7/1974 | McClay | 33/138 X |
| 3,845,559 | 11/1974 | Opper | 33/143 M |
| 4,355,472 | 10/1982 | Wedge | 33/480 |
| 4,379,419 | 4/1983 | Woock | 33/437 X |
| 4,393,600 | 7/1983 | Coe | 33/474 |

FOREIGN PATENT DOCUMENTS

| | | | |
|---|---|---|---|
| 18817 | of 1907 | United Kingdom | 33/437 |

*Primary Examiner*—Harry N. Haroian
*Attorney, Agent, or Firm*—John Cyril Malloy

[57] ABSTRACT

A device preferably in the form of a T-square having an elongated body and a perpendicularly arranged head portion and further including a plurality of staggered, offset scales extending along the length of said body from the head portion towards a distal end thereof. A plurality of scale indicators equal in number to the number of scales are provided to slide along the length of the body in aligned indicating relation with one of said plurality of scales. The device is specifically structured to locate, dimension and mark the proper locations for the formations of score lines in a multi-sided conduit or duct formed from a planar sheet of duct board wherein the device may be preset and maintained for the successive marking of a plurality of said planar duct board sheets without cause to reset the device each time a separate duct board is marked.

7 Claims, 9 Drawing Figures

MEASURING DEVICE

BACKGROUND OF THE INVENTION

1. Field of the Invention

Ths invention relates to a T-square type measuring device for locating and marking score lines along the length of a duct board such that the score lines can be formed at preselected locations on the interior surface of the duct board for folding thereof about itself and about the score lines into a multi-sided configuration which defines a hollow interior duct or conduit.

2. Description of the Prior Art

Measuring instruments and devices incorporating a T-square construction have been known in the prior art for many years. Typically, such devices were construction and utilized for the purposes of establishing a true straight edge or a reference line or base disposed in perpendicular relation to a central transverse or longitudinal axis of a paper or object to which the T-square construction was applied.

In the drafting technology, such devices were used as a true level horizontal base for the purpose of drawing other preferred angularly oriented lines. However, the T-square construction has been developed and expanded into numerous other technologies as evidenced by the devices disclosed in U.S. Pat. Nos. to Barrier, 685,369; Blizard, et al, 1,053,083; and Marsella, et al, 2,058,091. As disclosed in the above-noted patents, the T-square construction is used in combination with a scale, for purposes of measurement, and also with other diverse types of tools such as a cutting tool as disclosed in the above-noted patent to Marsella et al.

Other existing U.S. patents including U.S. Pat. No. 4,403,423 to Ford shows a drafting instrument including what may be referred to broadly as a T-square construction incorporating a reference scale. Also the patent to Wing, U.S. Pat. No. 4,279,081 discloses a wall board T-square specifically structured to have connecting elements secured thereto for the temporary attachment of the T-square to the face of a product such as a gypsum wall board so that a board cutting knife may be applied to the surface or face of the wall board. A cutting knife is thereby guided along a predetermined cut and prevents inadvertant damage or arbitrary cutting of the face of the board at any other location.

In the formation of ducting used for air conditioning, duct board normally is manufactured in sheets. These sheets are individually measured and scored so as to be folded upon themselves into a conduit or duct configuration having a hollow interior and a multi-sided exterior. Normally, when a large number of such duct boards are to be scored, such is done by conventional machinery known in the industry. However, such machinery is expensive and relatively heavy and bulky an does not lend itself to be used in the field. Therefore, there is a need in the industry for a measuring device capable of dimensioning and marking score lines of a duct board for cutting thereof. Such a measuring device is particularly applicable for field use wherein at least one and preferably a plurality of sheets need be properly dimensioned and scored and the larger, heavier machinery utilized for such purposes is not available.

SUMMARY OF THE INVENTION

The present invention is directed towards a measuring device incorporating a T-square construction by virtue of an elongated body and a head portion secured to one end thereof in substantially perpendicular relation thereto. The body is more specifically defined by spaced apart substantially parallel longitudinal sides or edges extending along the length of the body. An exposed surface is disposed in a recessed disposition between the longitudinal edges and a scale means is mounted thereon along the length of the body, or a major portion thereof. The scale means comprises a plurality of individual scales disposed in adjacent, side-by-side and parallel relation to one another. Further, the plurality of scales are arranged in a staggered, offset relation such that the measurement indicia formed on the outer face of each scale is staggered relative to the next adjacent scale, for purposes to be explained in greater detail hereinafter.

An indicator means in the form of a plurality of scale indicators are structured to slide along the length of the body in overlying and indicating relation to the scale means generally. A marker means is formed on each of the scale indicators in registry with one of the plurality of scales. Therefore, while each scale indicator is designed to travel along the length of all of the plurality of scales, the location of the respective marker means thereon is brought into aligned indicating relation with the measurement indicia of only one scale. Also, the number of individual scales is preferably equal to the number of scale indicators.

Further structural features of the present invention include the provision of a locking means which may be in the form of a connector element movably attached to each of the scale indicators and positionable relative thereto into engaging, abutting and fixed engagement with the body such that each of the indicators may be maintained in a preset position relative to the particular scale with which it is in registry. Also, a marker means is affixed to each of the scale indicators so as to travel therewith. This marker means extends outwardly from the remainder of the scale indicators and the body and is disposed and configured to allow markings to be made on the product being measured by the subject device in accord with the placement of the respective scale indicator relative to the measurement indicia on its respective scale.

In operation, the subject measuring device is used preferably to locate or determine the placement of score lines to be formed on one surface of a duct board. The duct board is of the type used to form an air conditioning duct or conduit by being folded upon itself. The resulting duct or conduit includes a multi-sided configuration. Again, in a preferred embodiment to be discussed in greater detail hereinafter, the duct or conduit is formed by laying out or determining the score lines between adjacent panels or sections of the duct board. The panels are to be folded relative to one another to obtain a substantially rectangular configuration as is well known in the prior art. In order to accomplish the intended configuration of the duct, substantially V-shaped score lines are formed by other conventional tools or instruments. Such a V-shaped score line facilitates folding of panel sections relative to one another into a substantially perpendicular orientation. The transverse dimension or width of the score lines must be considered when forming the conduit. This consideration is automatically accommodated by the arrangement of the plurality of individual scales on the exposed surface of the body in a staggered or offset relation to one another. More specifically, a first one of the scales is disposed a predetermined distance from the leading edge of the scale means or from the edge or line at which measurement of the scale means begins. This predetermined distance is equal to the width or transverse dimension of the score line. The plurality of successively positioned scales are spaced from the leading edge of the scale means successively greater distances to compensate for the width of each score line which precedes it. Therefore, the staggered, offset relation of the scale serves as an automatic means to compensate for the transverse dimensions of the score line and thereby provide a uniform cross-section of the duct being formed.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the nature of the invention, reference is had to the following detailed description taken in connection with the accompanying drawings in which.

Like reference numerals refer to like parts throughout the several views of the drawings.

DETAILED DESCRIPTION OF THE PREFERRED EMBODIMENT

Figure 4:
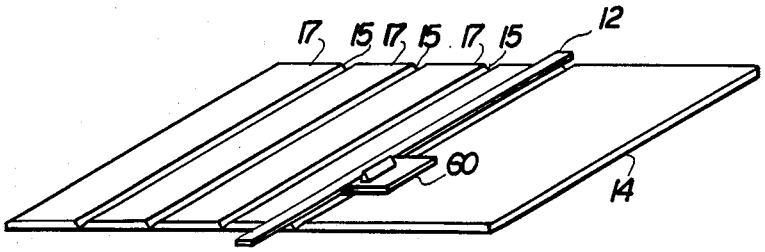
FIG. 4 is an isometric view showing the formation of the score line with a conventional cutting tool which is not per se a part of the present invention.
Figure 5:
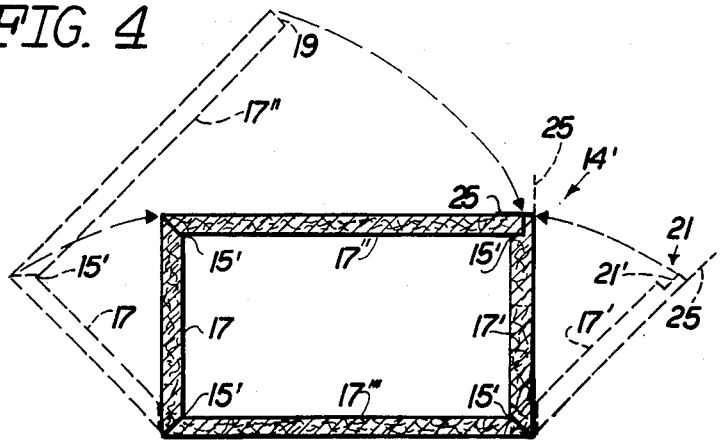
FIG. 5 is an end view of the formed conduit from the duct board shown in FIGS. 2 through 4 wherein sections thereof are folded relative to one another to form the resulting duct or conduit having a multi-sided configuration.

The present invention is directed to a measuring device generally indicated as 10 and used to locate and mark locations 13 for the placement of score line cuts 15 on duct board 14. With reference to FIGS. 2 through 5, the V-shaped score lines 13 are integrally formed or cut on the interior surface of the duct board 14 such that individual sections or panels 17 may be folded relative to one another to form a multi-sided conduit or duct 14' wherein junctions 15' are formed by the V-shaped score lines 15 cut in the duct board 14 as shown in FIGS. 4 and 5.

With reference to FIGS. 1 and 6 through 9, the structural details of the measuring device 10 comprise an elongated body 16 including a head portion 18 fixedly secured at one end thereof wherein a proximal side 20 of the head portion 18 is disposed in perpendicular relation to the longitudinal axis of the body and particularly oppositely disposed longitudinal peripheral edges 22 extending along the length of the body 16.

With reference to FIGS. 6 through 9, the body 16 includes a main face 23 sandwiched between transversely disposed longitudinal edges or sides 22. An exposed surface 24 is disposed in recessed relation to the upper edge 26 of each of the peripheral sides or edges 22. Scale means 28 is secured to the exposed surface 24 and extends along at least a major portion of the length thereof. In a preferred embodiment, the scale means 28 may be in the form of a flexible material strip adhesively secured to the surface 24 in a manner which will allow removal of the scale means strip 28 when it is scratched or damaged.

Figure 8:
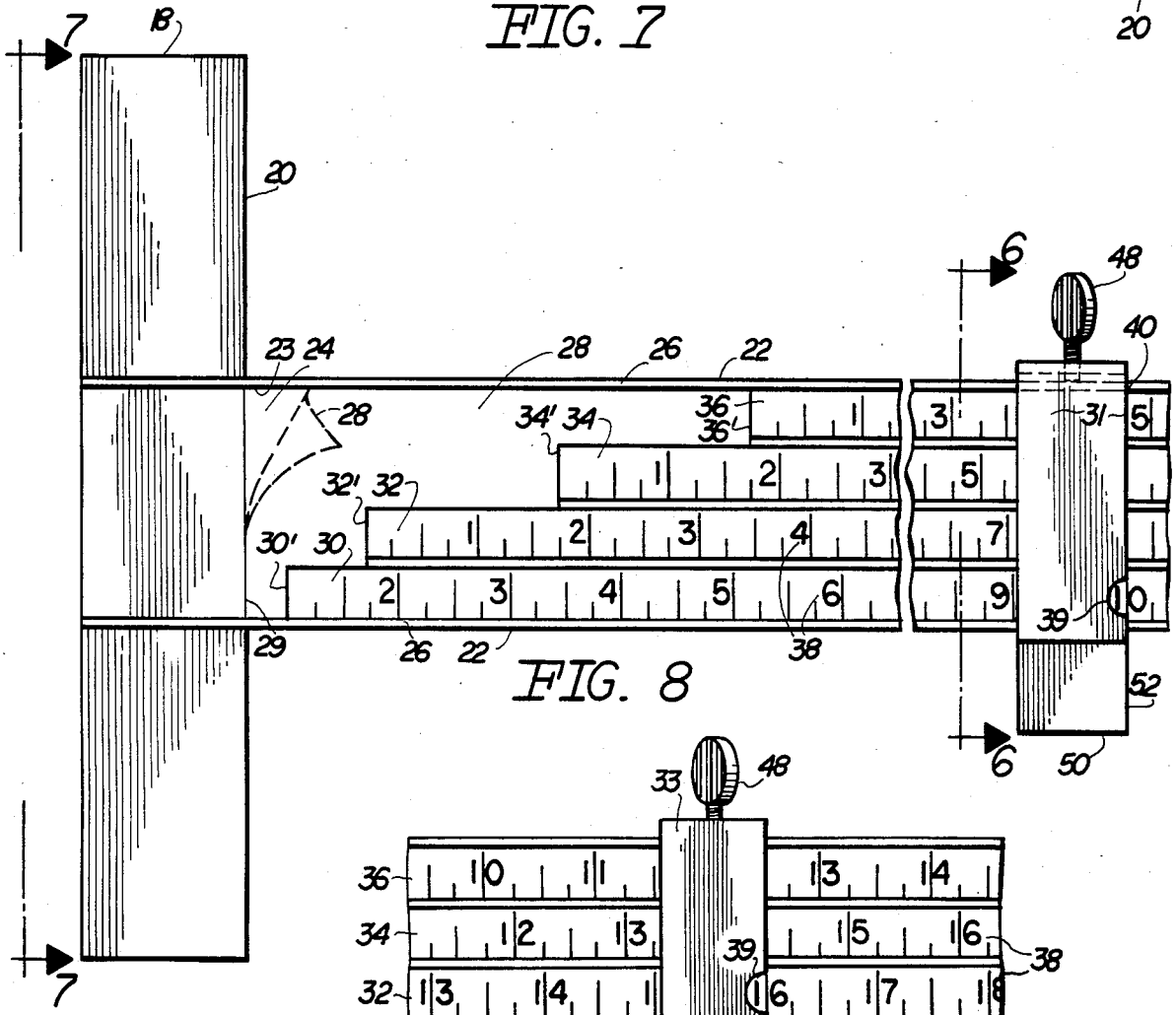
FIG. 8 is a front plan view in partial cutaway showing the relative, offset and staggered dispositions of the scale elements of the present invention.
Figure 9:
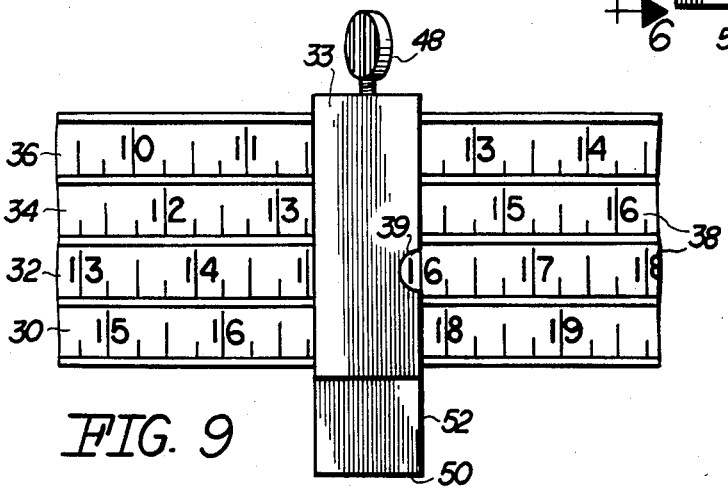
FIG. 9 is a detailed cutaway view showing placement of a scale indicator relative to a predetermined scale in which it is in registry.

The scale means 28 further includes a plurality of scales 30, 32, 34, and 36 disposed in staggered, offset relation to one another as clearly shown in FIG. 8. More specifically, the scale means 28 includes a leading end 29 which is in direct alignment with the one proximal end 20 of the head portion 18 and which begins the measurement of the scale means 28. The staggered offset relation of each of the plurality of scales 30 through 36 is accomplished by spacing each end 30', 32', 34' and 36' (FIG. 8) of these scales a predetermined greater distance from the leading or measuring end 29. The purpose for this staggered alignment of the respective scales is to accommodate or compensate for the transverse dimension of each of the score lines 15 formed in the duct board 14' as best shown in FIG. 4.

As shown in FIGS. 1, 6, 8 and 9, the device 10 of the present invention further comprises indicator means in the form of a plurality of scale indicators 31, 33, 35 and 37. The structural details of the scale indicators are the same except for the placement of the scale markers 39 formed on what may be referred to as a leading edge 40 of each scale indicator. Accordingly, a description of the structural details of scale indicator 31 as disclosed in FIG. 6 will be a description of each of the scale indicators, with the exception of the location of the scale marker 39. Each scale indicator includes a configuration to substantially surround the body 16 in overlying relation to the base 23 and scale means 28. Further, a main portion 41 of each scale indicator includes downwardly depending flanges being upturned as at 42 and forming an interiorly disposed track 44 for substantially surrounding engagement relative to the parallel longitudinally extending flanges 43, the outer surface of which defines the longitudinal edges 22.

Figure 6:
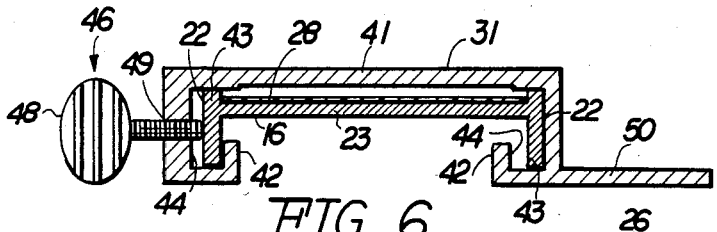
FIG. 6 is a sectional view taken along line 6—6 of FIG. 8 and showing strutural details of a scale indicator and body of the subject device.
Figure 7:
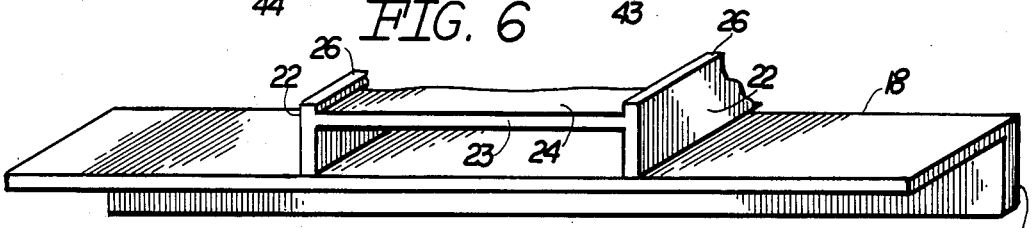
FIG. 7 is an isometric view in partial cutaway along line 7—7 of FIG. 8.

The marking means includes an outwardly extending flange 50 integrally formed to the scale indicator and having a marking edge 52 which is disposed in perpendicular relation to the longitudinal axis of the body 16. Also, marking edge 52 is on the same side of each scale indicator as is each scale marker 39 and is in colinear relation with the leading edge 40 of each scale indicator as clearly shown in FIG. 8. (See FIGS. 8 and 9.) In addition, a locking means generally indicated as 46 is movably and threadably attached to the scale indicator and rotatable by turning of head or know portion 48 so as to accomplish abutting, fixed engagement between the connector element 46 and one of the longitudinal edges 22 as best shown in FIG. 6. By virtue of this construction, each of the scale indicators may be fixedly positioned at a given location along the length of the scale means 28 and more specifically at or along the dimensional indicia 38 preselected and as indicated by the scale marker 39. Note that each scale marker 39 on the various scale indicators 31, 33, 35 and 37 are specifically disposed for alignment with only one of a plurality of scales 30, 32, 34 and 36 respectively.

Figure 1:
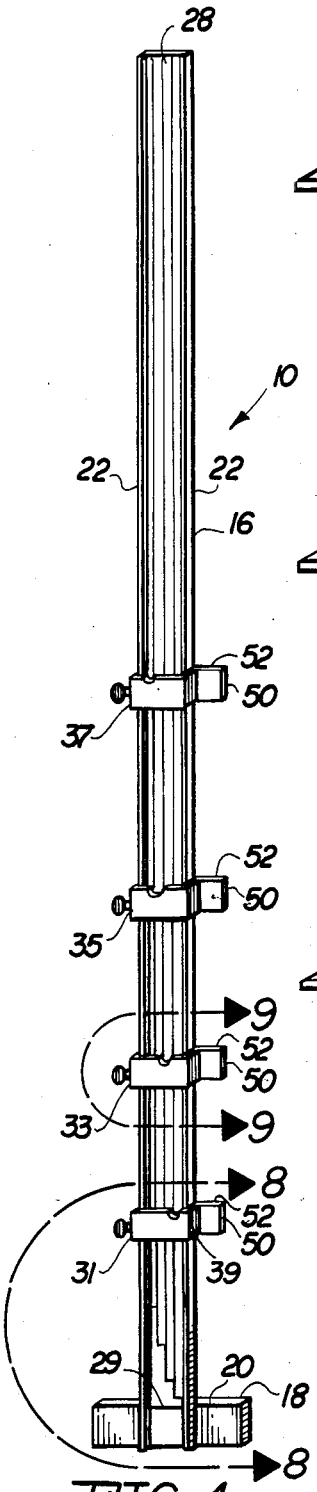
FIG. 1 is an isometric view of the measuring device of the subject invention.
Figure 2:
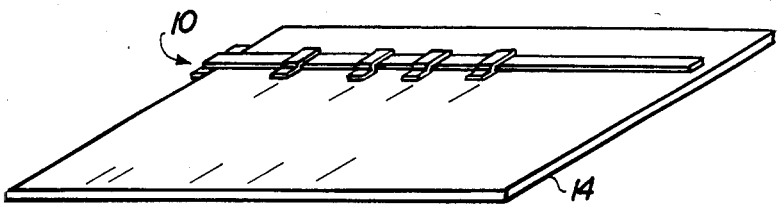
FIG. 2 is an isometric view of the subject device being applied to a duct board for purposes of marking such duct board appropriately for the location of score lines.
Figure 3:
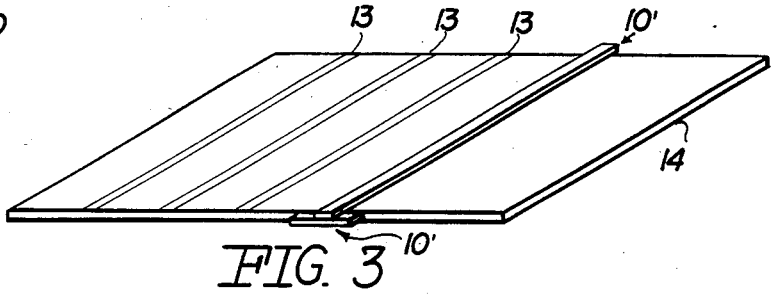
FIG. 3 is an isometric view of the device of the subject invention as applied to the duct board in the embodiment of FIG. 2 but used as a straight edge for aligning appropriately located marks in the dimensioning and location of the score lines.

By way of example, if the conduit as shown in FIG. 5 has a dimension of 10×6, each of the plurality of scale indicators 31, 33, 35 and 37 are successively placed at indications along their respective scales as follows. Indicator 31 is affixed at 10 inches along its respective scale 30. Indicator 33 is affixed along its respective scale at 16 as shown respectively in FIGS. 8 and 9. (Note 10+6=16.) Similarly, indicator 35 is positioned on its scale at 26 (10+6+10) and indicator 7 is placed on its scale at dimensional indicia 32 (10+6+10+6=32). Since each of the indicators are fixed through the provision of the locking means 46, markings are made, as shown in FIG. 2, on a first sheet 14. (See FIG. 2). Once the markings are properly made on opposite ends of the sheet as shown in FIG. 2, a straight edge is used to connect the line and thereby indicate along the entire appropriate dimension of sheet 14 where the score lines are to be cut.

Further with regard to FIG. 5, the plurality of duct board sections or panels 17 are brought into a closed configuration by the joining interengagement of extremity 19 (along the entire length thereof) and the correspondingly positioned extremity generally indicated as 21. To accomplish mating engagement therebetween, extremity 21, along its entire length, has a substantially L-shaped cutout portion such that surface 21' of the extremity 21 engages in sealing and/or abutting engagement with the extremity 19 as shown in solid lines in FIG. 5. An outwardly extending tape or overlapping flap element 25 extends outwardly from the extremity 21. When the extremities 21 and 19 are brought into engaging relation, as represented in solid lines in FIG. 5, the elongated flap 25 is folded over about the junction, and adhered thereto such as by adhesive, tape, or any like connecting means. As a result of the specifically configured extremities 19 and 21 causing their interengagement, the overall length of the panel segment or section 17'' is somewhat shorter than the correspondingly positioned, spaced apart panel segments 17' as is evident from the cross-section represented in FIG. 5.

With reference to FIG. 4, a straight edge 12 or the dimensioning tool 10' again may be utilized for alignment with the intended position of the score line for utilization of a tool 60 for forming of the score lines 15 with the appropriate V-cut as set forth above. Once so formed, the conduit may be folded into its intended position as shown in FIG. 5. When a next duct sheet 14 is ready for sizing and scoring, the indicator elements do not have to be repositioned but are maintained in the intended position due to the operation of the locking means 46.

What is claimed is;

1. A measuring device of the type primarily designed to locate a plurality of score lines and accomplish required dimensioning of a duct board structure to be folded upon itself at the score lines in the formation of an elongated hollow interior, multi side conduit, said device comprising:

(a) a body having an elongated configuration and oppositely disposed spaced apart and substantially parallel longitudinal edges extending the length thereof, (b) a head portion secured at one end of said body and extending outwardly from each longitudinal edge in substantially transverse relation thereto, (c) said head portion including one side having a linear configuration extending perpendicularly outward from said body, (d) an exposed surface mounted on said body along the length thereof and disposed between said longitudinal edges and in inwardly recessed relation below said longitudinal edges, (e) scale means formed on said exposed surface of said body and comprising a plurality of elongated scales each extending along the length of said body in adjacent and parallel relation to one another, (f) a leading end of said scale means being disposed in aligned relation to said one side of said head portion and defining a beginning point of measurement of said scale means, a first of said scales having a beginning end disposed a predetermined spaced distance from said leading end, a remainder of said scales each disposed a successively greater spaced distance from said leading end to define a staggered, offset relation to one another, (g) said predetermined spaced distance of said first scale and said successively greater spaced distances of the remainder of said scales being dimensioned to compensate for the dimension of respective ones of the plurality of score lines formed in the duct board, (h) indicator means comprising a plurality of scale indicators each movably mounted on said body above and out of context with said scale means and each selectively positionable along the length of said scale means in aligned relation to a different one of said plurality of scales, (i) said plurality of scale indicators being equal in number to the number of said plurality of scales and equal to or greater than the number of sides of the multi sided conduit being formed, (j) each scale indicator comprising a scale marker formed thereon, each scale marker located on its respective scale indicator at a different location from the other scale markers on their respective scale indicators and each scale marker disposed in registry with a different one of said plurality of scales, (k) marker means for marking the duct board at designated spaced apart locations fixedly formed on each of said scale indicators and structured to travel therewith along the length of said body, (l) locking means secured to each of said scale indicators and structured for removable securement of each scale indicator at a selected location along the length of said scale means, and (m) whereby said scale indicators may be located and fixed at predetermined locations along said scale means for successive markings of score lines on a plurality of duct boards.

2. A device as in claim 1 wherein respective ones of said locking means are structured and disposed for fixed interconnection between said respective scale indicators and said body and fixed positioning of said scale markers in aligned relation to different ones of said scales.

3. A device as in claim 1 wherein each of said depending flanges comprise a leading edge having a straight line configuration and disposed in colinear relation with a leading edge of said scale indicator on which it is secured; each of said scale markers integrally formed along said leading edge of a different one of said scale indicators.

4. A device as in claim 1 wherein said one side of said head portion is disposed on a proximal side of said head portion and extends in depending relation to an undersurface of said body.

5. A device as in claim 1 wherein said scale means comprises an elongated strip removably secured to said body and extending along the length thereof.

6. A device as in claim 5 wherein said scale means is formed of a flexible material and said strip is adhesively secured to said body along the length of said recessed exposed surface.

7. A device as in claim 1 wherein said locking means comprises a connector element threadedly attached to each of said scale indicators and selectively positionable into and out of abutting, fixed engagement with said body.

* * * * *